US011804116B2

(12) United States Patent
Schultz et al.

(10) Patent No.: US 11,804,116 B2
(45) **Date of Patent: *Oct. 31, 2023**

(54) TETHERED SECURITY DEVICE FOR USE WITH AN ELECTRONIC KEY

(71) Applicant: InVue Security Products Inc., Charlotte, NC (US)

(72) Inventors: Robert Schultz, Franklin, TN (US); Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/499,377

(22) Filed: Oct. 12, 2021

(65) Prior Publication Data

US 2022/0028231 A1 Jan. 27, 2022

Related U.S. Application Data

(63) Continuation of application No. 16/739,788, filed on Jan. 10, 2020, now abandoned, which is a (Continued)

(51) Int. Cl.

| | |
|---|---|
| ***G08B 13/14*** | (2006.01) |
| ***G08B 13/12*** | (2006.01) |
| ***G08B 13/06*** | (2006.01) |

(52) U.S. Cl.

CPC ..... *G08B 13/1445* (2013.01); *G08B 13/06* (2013.01); *G08B 13/12* (2013.01)

(58) Field of Classification Search

CPC ..... G08B 13/1445; G08B 13/06; G08B 13/12

See application file for complete search history.

(56) References Cited

U.S. PATENT DOCUMENTS

| | | | |
|---|---|---|---|
| 5,400,246 | A | 3/1995 | Wilson et al. |
| 5,912,619 | A | 6/1999 | Vogt |

(Continued)

FOREIGN PATENT DOCUMENTS

| | | | |
|---|---|---|---|
| CN | 202650163 | U | 1/2013 |
| EP | 1027514 | B1 | 4/2002 |
| WO | 2011035302 | A1 | 3/2011 |

OTHER PUBLICATIONS

First Office Action from corresponding Chinese Patent Application No. 201480062228.1, dated Mar. 20, 2017 (10 pages).

(Continued)

*Primary Examiner* — Daryl C Pope

(74) *Attorney, Agent, or Firm* — InVue Security Products Inc.

(57) ABSTRACT

A merchandise security device is provided. The merchandise security device may include a base configured to be attached to a support surface. The base includes an alarm circuit and a tether, and the tether is configured to be extended and retracted relative to the base and to be coupled to one or more items of merchandise. The alarm circuit is configured to detect removal of the base from the support surface, cutting of the tether, and/or removal of the tether. In addition, the security device includes a lock mechanism configured to lock to the tether for securing the one or more items of merchandise to the tether, wherein one or more items of merchandise are removable from the tether when the lock mechanism is unlocked.

19 Claims, 9 Drawing Sheets

Related U.S. Application Data continuation of application No. 16/199,787, filed on Nov. 26, 2018, now Pat. No. 10,535,239, which is a continuation of application No. 15/036,112, filed as application No. PCT/US2014/065359 on Nov. 13, 2014, now Pat. No. 10,140,824.

(60) Provisional application No. 61/904,986, filed on Nov. 15, 2013.

(56) References Cited

U.S. PATENT DOCUMENTS

| | | | |
|---|---|---|---|
| 6,799,994 | B2 | 10/2004 | Burke |
| 7,053,774 | B2 | 5/2006 | Sedon et al. |
| 7,209,038 | B1 | 4/2007 | Deconinck et al. |
| 7,327,276 | B1 | 2/2008 | Deconinck et al. |
| 7,350,645 | B1 | 4/2008 | Sills |
| 7,385,522 | B2 | 6/2008 | Belden, Jr. et al. |
| 7,406,846 | B2 | 8/2008 | Chu |
| 7,575,224 | B1 | 8/2009 | Madland |
| 7,629,895 | B2 | 12/2009 | Belden, Jr. et al. |
| 8,171,761 | B2 | 5/2012 | Kidd |
| 8,453,937 | B2 | 6/2013 | Kolton et al. |
| 8,537,012 | B2 | 9/2013 | Rapp et al. |
| 8,596,595 | B2 | 12/2013 | Devito |
| 8,604,927 | B2 | 12/2013 | Sisney |
| 8,950,223 | B1 | 2/2015 | Joyce |
| 10,140,824 | B2 | 11/2018 | Schultz et al. |
| 10,535,239 | B2 * | 1/2020 | Schultz ..... G08B 13/12 |
| 2005/0073413 | A1 | 4/2005 | Sedon et al. |
| 2007/0194918 | A1 | 8/2007 | Rabinowitz et al. |
| 2010/0155265 | A1 | 6/2010 | Kidd |
| 2011/0309928 | A1 | 12/2011 | Henson et al. |
| 2011/0309934 | A1 | 12/2011 | Henson et al. |
| 2012/0019383 | A1 | 1/2012 | Fawcett et al. |
| 2012/0103031 | A1 | 5/2012 | Grant et al. |
| 2012/0205325 | A1 | 8/2012 | Richter et al. |
| 2012/0217371 | A1 | 8/2012 | Abdollahzadeh et al. |
| 2012/0268103 | A1 | 10/2012 | Henson et al. |
| 2014/0027390 | A1 | 1/2014 | Reynolds et al. |
| 2014/0159898 | A1 | 6/2014 | Wheeler et al. |
| 2015/0061871 | A1 | 3/2015 | Davies |
| 2015/0097008 | A1 | 4/2015 | Adeyemi |
| 2016/0270373 | A1 | 9/2016 | Bova et al. |
| 2019/0096204 | A1 | 3/2019 | Schultz et al. |
| 2020/0005611 | A1 | 1/2020 | Taylor |
| 2020/0152026 | A1 | 5/2020 | Schultz et al. |

OTHER PUBLICATIONS

Extended European Search Report from corresponding EP Application No. 14861589.1, dated Oct. 6, 2016 (11 pages).

PCT/US2014/065359, International Search Report and Written Opinion, dated Mar. 26, 2015, 9 pages.

* cited by examiner

TETHERED SECURITY DEVICE FOR USE WITH AN ELECTRONIC KEY

CROSS REFERENCE TO RELATED APPLICATIONS

This application is a continuation of and claims priority to U.S. application Ser. No. 16/739,788, filed on Jan. 10, 2020, which is a continuation of U.S. application Ser. No. 16/199,787, filed on Nov. 26, 2018, and now U.S. Pat. No. 10,535,239, which is a continuation of U.S. application Ser. No. 15/036,112, filed on May 12, 2016, and now U.S. Pat. No. 10,140,824, which is a 371 National Phase Entry of International Application No. PCT/US2014/065359, filed on Nov. 13, 2014, which is a nonprovisional of and claims the benefit to priority of U.S. Provisional Patent Application No. 61/904,986 filed on Nov. 15, 2013, the entire disclosure of which is incorporated herein by reference.

FIELD OF THE INVENTION

Embodiments of the present invention relate generally to merchandise display security devices, systems, and methods for protecting an item of merchandise from theft.

BACKGROUND OF THE INVENTION

It is common practice for retailers to store and/or display relatively expensive items of merchandise on or within a merchandise security device, such as a security display (e.g. alarming stand), security fixture (e.g. locking hook, shelf, cabinet, etc.) or security packaging (e.g. merchandise keeper). Regardless, the security device stores and/or displays an item of merchandise so that a potential purchaser may view, and in some instances, interact with the item before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display or to remove the item from the security fixture or from within the security packaging. Alternatively, the shoplifter may attempt to remove the or a portion of the security device from the display area along with the item.

In the case of a secure display or fixture, the security device is oftentimes firmly attached to a support, such as a pegboard, wire grid, horizontal bar rack, slatwall (also known as slatboard), wall, table, desk, countertop or like structure. In some instances, the security device is secured to the support using a rod with a mechanical lock mechanism operated by a non-programmable key, for example a conventional tumbler lock or a magnetic lock. Accordingly, there exists a need for an improved merchandise security device for items of merchandise.

BRIEF SUMMARY

Embodiments of the present invention are directed to merchandise display security systems and methods for securing items of merchandise from theft. In one embodiment, a merchandise display security device includes a base configured to be attached to a support surface. The base includes an alarm circuit and a tether, and the tether is configured to be extended and retracted relative to the base and to be coupled to one or more items of merchandise. The alarm circuit configured to detect removal of the base from the support surface, cutting of the tether, and/or removal of the tether. In addition, the security device includes a lock mechanism configured to lock to the tether for securing the one or more items of merchandise to the tether, wherein one or more items of merchandise are removable from the tether when the lock mechanism is unlocked.

In another embodiment, a merchandise display security system is provided and includes an electronic key, as well as a merchandise security display device similar to that described above. A lock mechanism is configured to be operated by electrical power transferred from the electronic key to the lock mechanism.

In another embodiment, a method for securing an item of merchandise from theft is provided. The method comprises attaching a base to a support surface, wherein the base includes an alarm circuit and a tether. The tether is configured to be extended and retracted relative to the base and to be coupled to one or more items of merchandise, and the alarm circuit is configured to detect removal of the base from the support surface, cutting of the tether, and/or removal of the tether. The method further includes coupling the tether to one or more items of merchandise, and locking a lock mechanism to the tether such that the one or more items of merchandise are secured to the tether.

DETAILED DESCRIPTION OF EMBODIMENTS OF THE INVENTION

Figure 1:
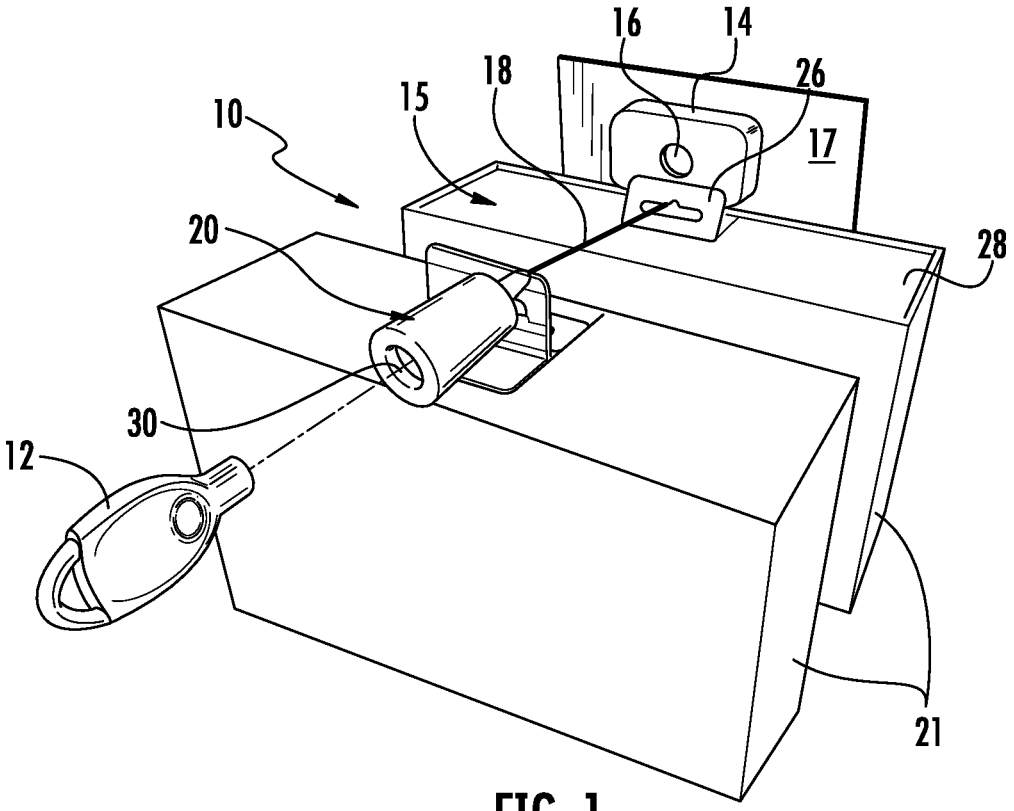
FIG. 1 is a perspective view of a merchandise display security system according to one embodiment of the present invention.

Referring now to the accompanying drawing figures wherein like reference numerals denote like elements throughout the various views, one or more embodiments of a merchandise display security system are shown. In the embodiments shown and described herein, the system includes an electronic key and a merchandise security device. In some embodiments shown and described herein, the merchandise security device is employed for shelf security whereby items of merchandise displayed on a shelf or other support surface are secured. For example, the merchandise security device may be suitable for use with a variety of display surfaces, such as pegboard, slat board, slat wall, counter, and the like. The electronic key may be useable with any security device that utilizes power transferred from the key to operate a lock mechanism associated with the security device and/or utilizes data transferred from the key to authorize the operation of a lock mechanism, such as an alarm circuit. In other words, an electronic key according to embodiments of the invention is useable with any security device or lock mechanism that requires power transferred from the key to the device and/or data transferred from the key to the device. It should be noted that although the invention is described with respect to embodiments including an electronic key for transferring both data and electrical power to a merchandise security device to operate a mechanical lock mechanism and/or an alarm circuit, the invention is equally applicable to an electronic key for transferring only electrical power to a merchandise security device to operate any component of the merchandise security device (e.g., a lock mechanism), whether or not the device includes an internal or external power source for operating another component of the device.

Figure 2:
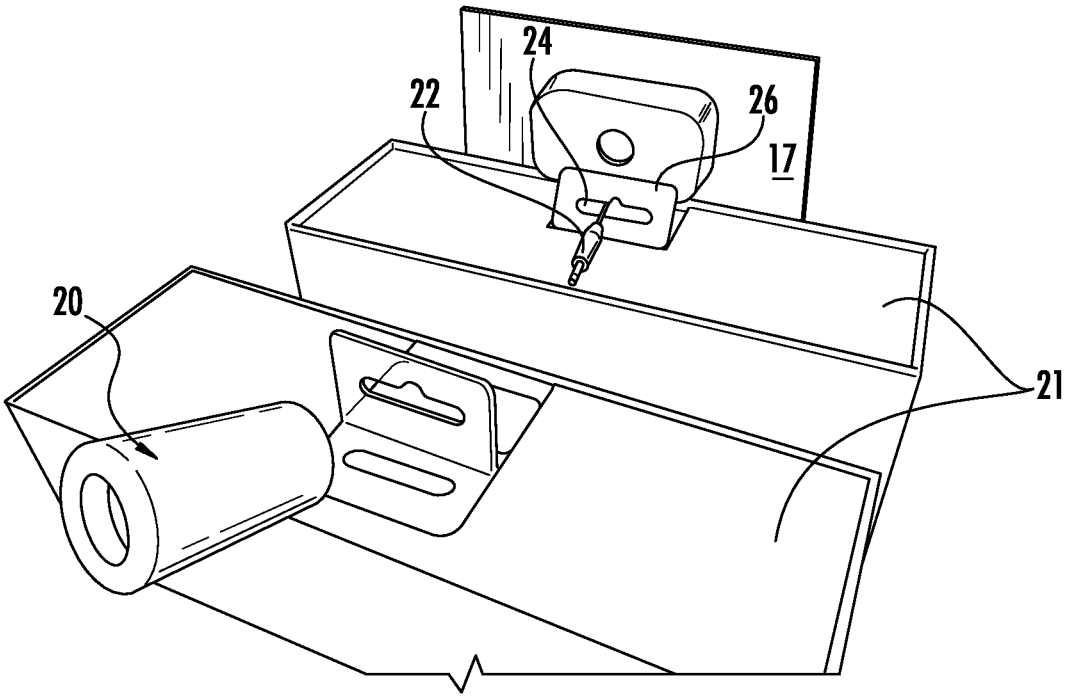
FIG. 2 is a partially disassembled view of the merchandise display security system shown in FIG. 1.

One embodiment of a merchandise display system 10 according to the invention is illustrated in FIGS. 1 and 2. The embodiment of the merchandise display security system 10 generally comprises an electronic key 12 and a merchandise security device 15 that is configured to be operated by the key. In some cases, the security device 10 is configured to cooperate with the electronic key 12 for locking and/or unlocking a lock mechanism 20. In some embodiments, the electronic key 12 is also configured to arm and disarm an alarm circuit. FIG. 1 shows that the security device 15 generally includes a base 14 configured to be secured to a support surface 17, such as, for example, pegboard, slat wall, slat board, and the like. In some cases, the base 14 may be secured to any surface with an adhesive and/or fasteners. The base 14 may include a transfer port 16 for communicating with the electronic key 12, as discussed in further detail below. Thus, in some cases, the base 14 may include an alarm circuit that is configured to be armed and/or disarmed with the electronic key 12. However, in other embodiments, the base 14 may simply provide mechanical security for securing the base to a support surface 17. The system 10 further includes a tether 18 that is configured to extend and retract relative to the base 14. The tether 18 may be coupled to one or more items of merchandise 21 such that each item of merchandise is able to slide between the lock mechanism 20 and a support surface 17. The tether 18 may be any suitable cable, cord, or the like, and in some cases, may be flexible.

Figure 3:
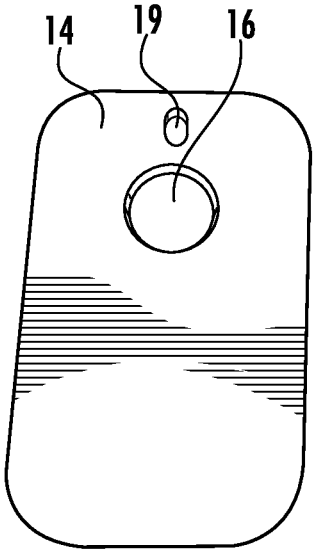
FIG. 3 is a plan view of a base according to one embodiment of the present invention.
Figure 4:
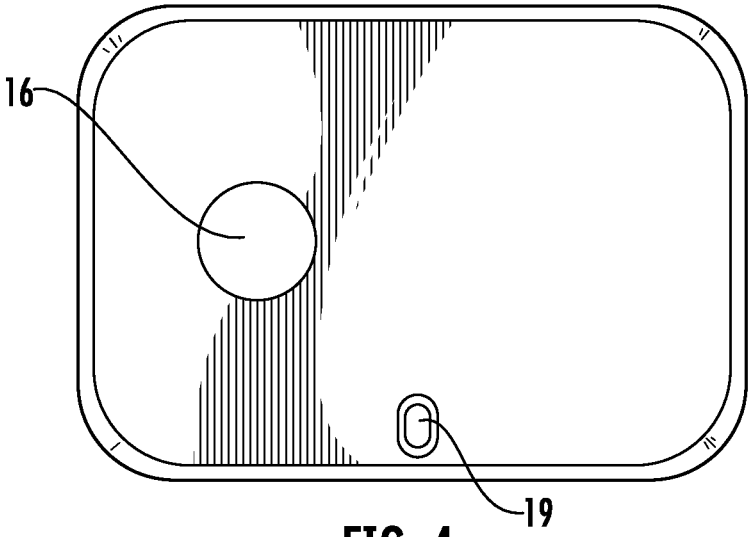
FIG. 4 is a plan view of a base according to another embodiment of the present invention.

In some embodiments, the base 14 includes an opening 19 configured to receive the tether 18 therethrough. FIGS. 3-4 show that the opening 19 and transfer port 16 may be located at various positions on the base 14. Doing so allows the base 14 to be arranged in various orientations on the support surface 17, such as for example, behind items of merchandise 21, above items of merchandise, or to the side of items of merchandise. In one embodiment, the tether 18 is coupled to a recoiler that is wound within the base 14 and is configured to unwind as tension is applied to the end of the tether (see, e.g., FIGS. 6 and 14). In some embodiments, the tether 18 provides mechanical security only, while in other embodiments, the tether may include one or more conductors electrically connected to an alarm circuit. Thus, the alarm circuit may be configured to detect when the tether 18 is cut or removed from the base 14 in an unauthorized manner. In other embodiments, the tether 18 may include both a cut resistant cable and conductors, although only a cut-resistant cable may be utilized if desired. Moreover, the base 14 may include a sensor that is configured to be activated upon unauthorized removal of the base from a support surface 17, and the sensor may in electrical communication with an alarm circuit. For example, the sensor may be a pressure or plunger switch (see, e.g., FIG. 13). Thus, the alarm circuit may be configured to detect activation of the sensor and to generate an audible and/or a visible alarm signal in response to the sensor being activated.

Figure 5:
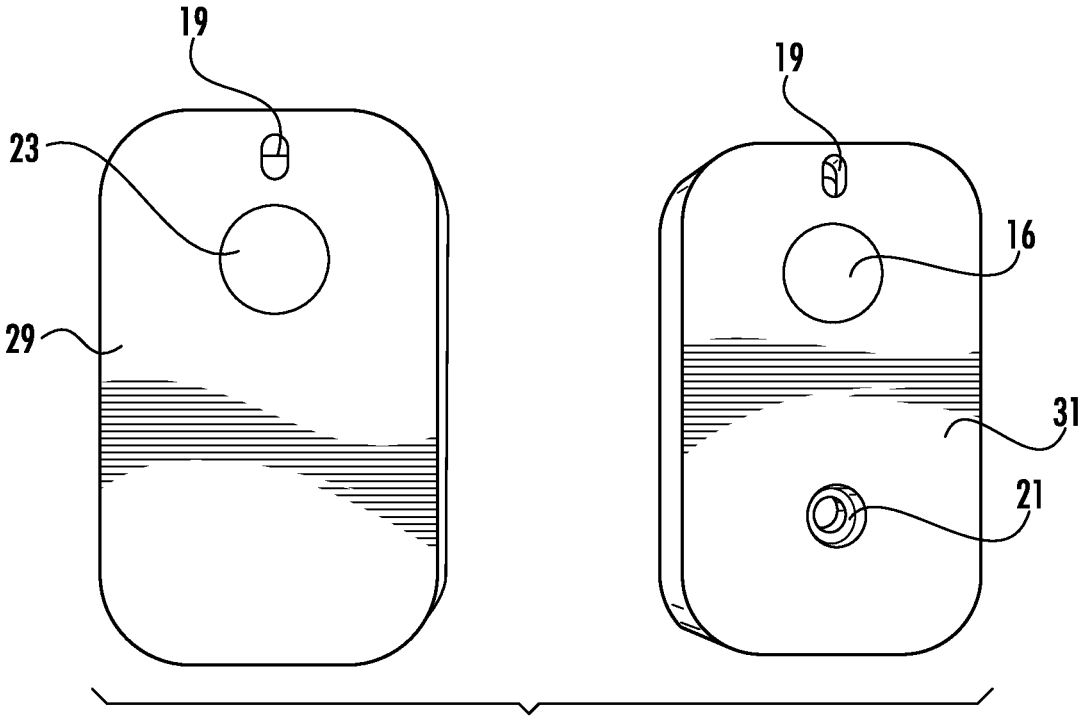
FIG. 5 is a plan view of a base according to another embodiment of the present invention.
Figure 6:
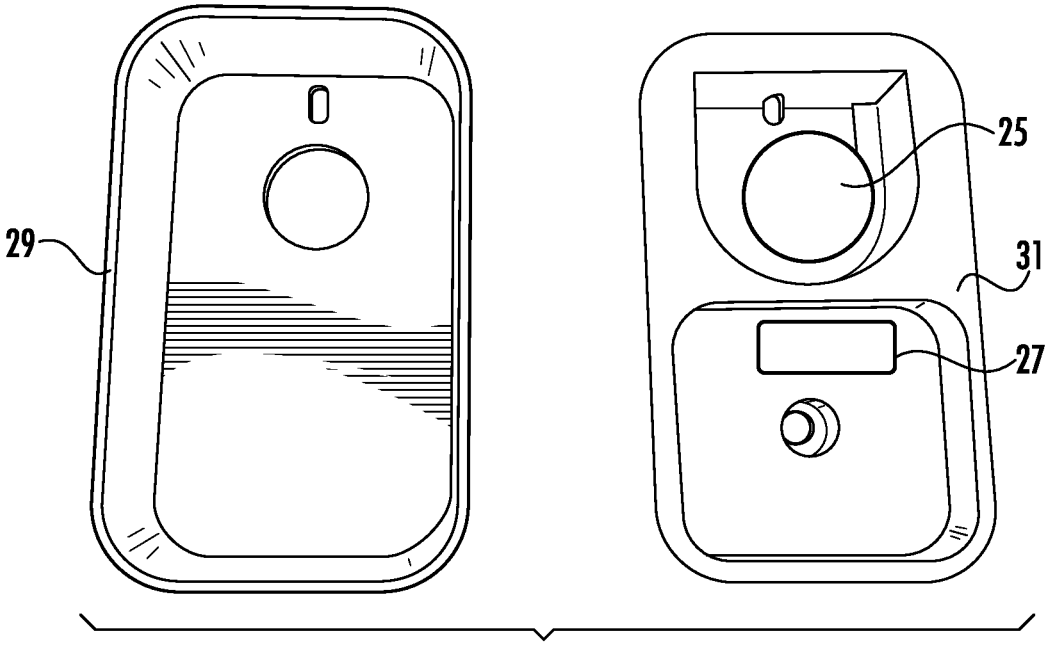
FIG. 6 is another plan view of the base shown in FIG. 5.

FIGS. 5 and 6 show one example of a base 14. In this example, the base 14 is a two-piece housing with an outer housing 29 configured to be secured to an inner housing 31, for example, in a snap fit. The inner housing 31 may be configured to be secured to a support surface 17 as noted above. In this example, the inner housing 31 may define one or more openings 21 for receiving a fastener therethrough. The fastener may be configured to engage a bracket or similar adapter that is engaged with the support surface 17, such as, for example, pegboard or slatwall. Moreover, FIG. 5 shows that the outer housing 29 may include an opening 23 configured to align with the transfer port 16. In addition, each of the inner 31 and outer 29 housings may include an opening 19 for receiving the tether 18 therethrough. FIG. 6 shows the opposite surface of the inner 31 and outer 29 housings. The outer housing 29 may be shaped to receive the inner housing 31 therein, while the inner housing may include one or more recesses for receiving a recoiler 25 and/or the alarm circuit 27, as discussed above.

Figure 15:
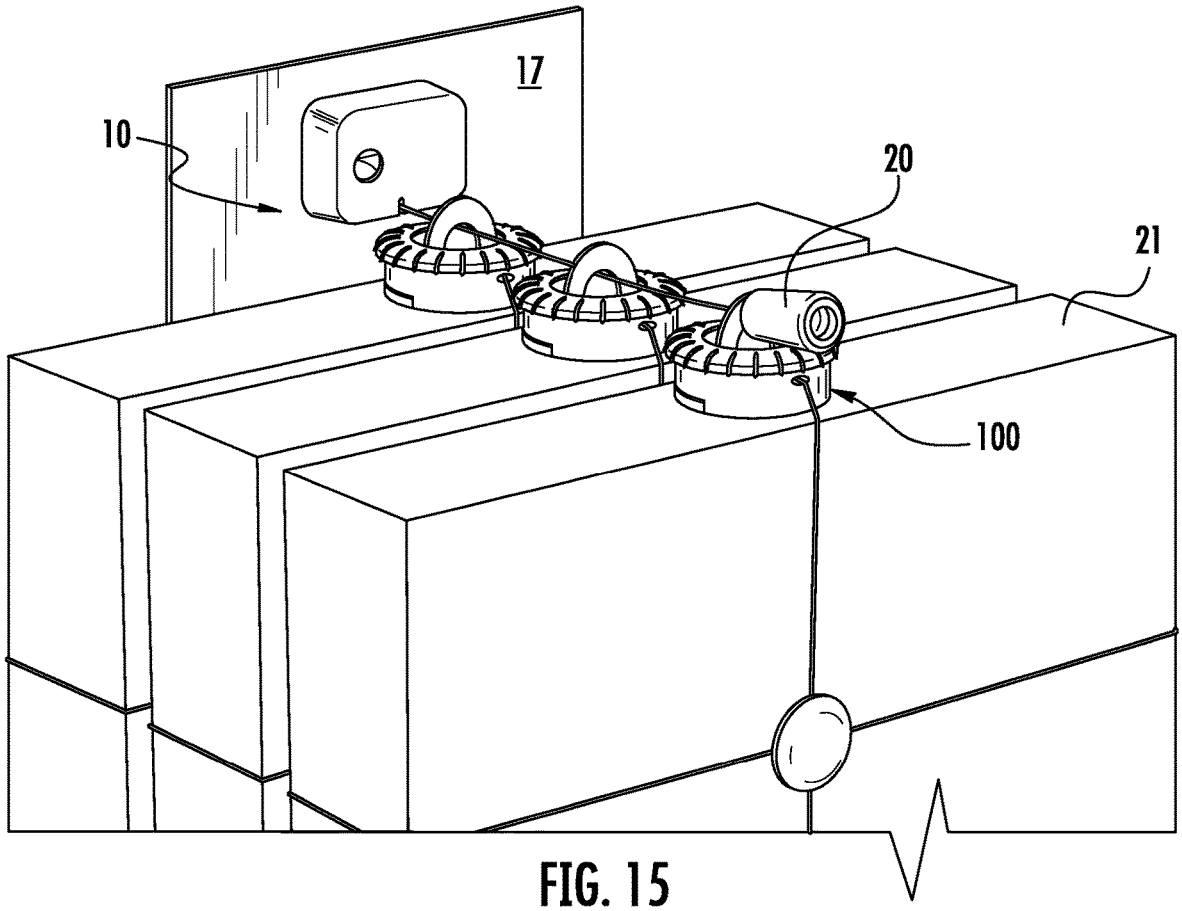
FIG. 15 is a perspective view of a merchandise display security device in use with a cable wrap according to one embodiment of the present invention.

A lock mechanism 20 is configured to be locked or otherwise coupled to the tether 18. The lock mechanism 20 is configured to secure items of merchandise to the tether 18, and an item of merchandise cannot be removed without first unlocking the lock mechanism or otherwise damaging the item of merchandise or the tether 18. In some embodiments, the lock mechanism 20 is configured to releasably engage an end of the tether 18. For example, FIG. 1 shows the lock mechanism 20 engaged with an end of the tether 18, while FIG. 2 shows the lock mechanism disengaged from the end of the tether. The end of the tether 18 may include a connector 22 that is configured to be engaged with and disengaged from the lock mechanism 20. The connector 22 may be any desired configuration for engaging the lock mechanism 20. In the illustrated example, the connector 22 is a plug configured to be inserted within the lock mechanism 20. It is noted that the size and configuration of the connector 22 is such that the connector may be inserted through an opening 24 defined in a hang tag 26 on an item of merchandise 21. For instance, FIG. 2 shows that when the connector 22 is disengaged from the lock mechanism 20, the connector is able to be inserted through the hang tag opening 24 to allow a consumer to inspect or purchase the item of merchandise. When unlocked from the lock mechanism 20 or the lock mechanism is other removed from the tether 18, the connector 22 may be inserted through one or more hang tags 26 associated with the items of merchandise 21. Thus, the security device 10 provides a similar consumer experience as locking hooks used with pegboard, slat wall, and the like. As shown in FIGS. 1 and 15, the tether 18 is configured to accommodate a plurality of items of merchandise. In some cases, such as shown in FIG. 15, the security device 10 may be used in conjunction with secondary security devices, such as cable wraps 100. Each cable wrap 100 may be configured to secure an item of merchandise 21 and may include a hang tag 26 for coupling to the tether 18.

Figure 7:
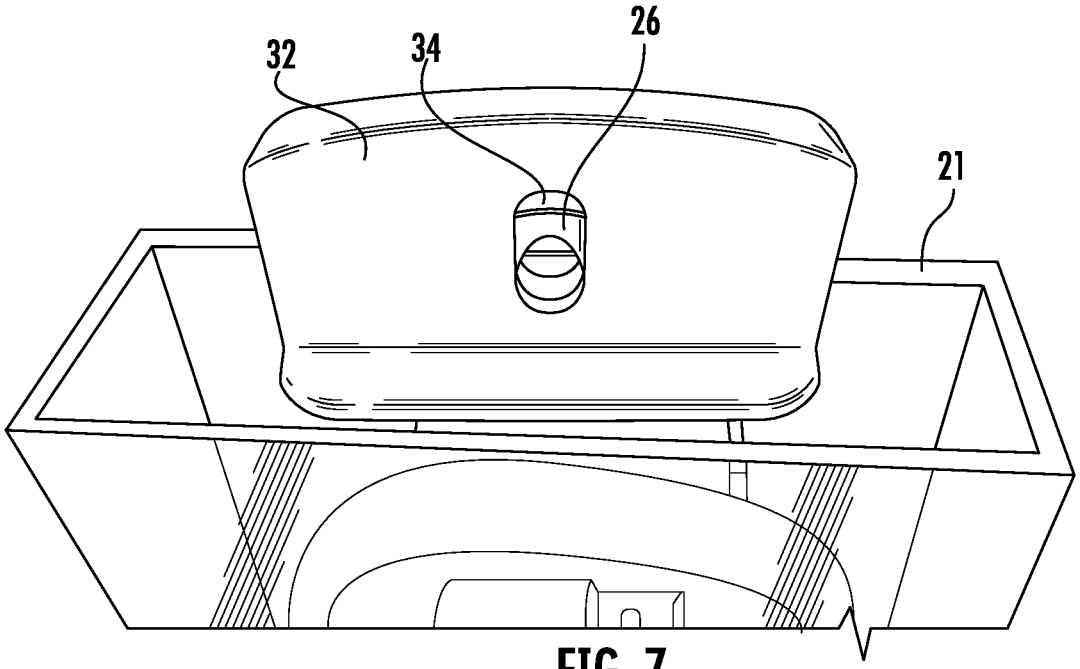
FIG. 7 is an enlarged perspective view of a hang tag attached to an item of merchandise according to an embodiment of the present invention.

In one embodiment, a reinforced hang tag 32, such as shown in FIG. 7, may be used. The reinforced hang tag 32 may have a similar shape to the hang tag 26 on the item of merchandise 21 or may be secured to items of merchandise with no hang tag. The reinforced hang tag 32 may include a slot for receiving an existing hang tag 26, as well as an opening 34 for aligning with an existing hang tag and receiving the connector 22 and tether 18 therethrough. The reinforced hang tag 32 may be secured to an outer surface of the item of merchandise 21 with a pressure sensitive adhesive or the like. Thus, the reinforced hang tag 32 may provide additional security for hang tags 26 that may not otherwise be robust or cut resistant and also allows items of merchandise 21 with no hang tags to be compatible with the security device 10.

In some embodiments, the lock mechanism 20 may be configured to lock to and unlock from the connector 22. The lock mechanism 20 may include a transfer port 30 for communicating with an internal lock mechanism for disengaging the connector 22. For example, the lock mechanism 20 may include an electrical conductor in the form of a coil having a plurality of continuous windings. The coil is arranged to correspond to a transfer port 30 of the lock mechanism 20. Thus, an electronic key 12 may be positioned within or proximate to the transfer port 30 for communicating with the lock mechanism 20. In one example, the electronic key 12 is configured to be inserted within an opening defined by the coil and transfer power to the coil inductively. The coil may be in electrical communication with a wire formed of shape memory material that is configured to shorten when power is conducted through the coil, as explained in further detail below.

Figure 8:
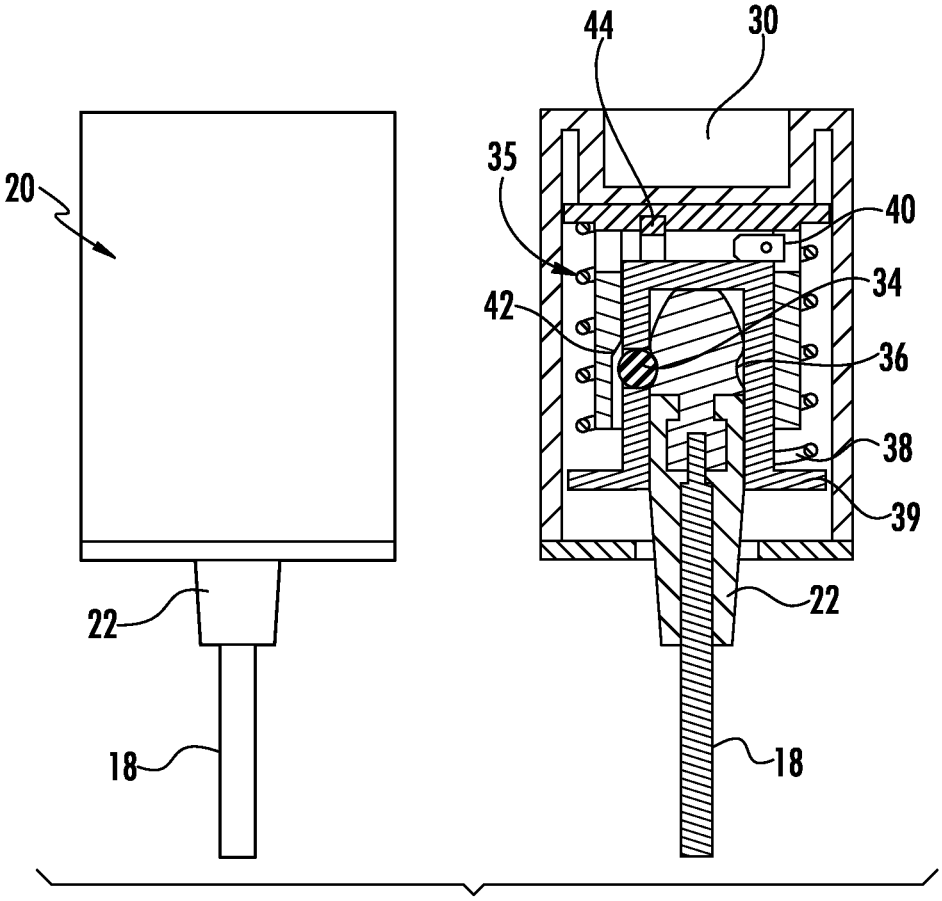
FIG. 8 shows a side view and a cross-sectional view of a lock mechanism according to one embodiment of the present invention.

FIG. 8 shows one embodiment of a lock mechanism 20 engaged with a connector 22 in a locked configuration. As shown, the connector 22 is configured to be inserted within the lock mechanism 20. The lock mechanism 20 includes a lock 35, such as a ball clutch, wherein a plurality of balls 34 are configured to engage the connector 22. In this example, the connector 22 may include a recess 36 that is configured to receive a portion of each ball 34 in the recess in a locked configuration. The recess 36 may extend circumferentially about the connector 22. The lock mechanism 20 may also define a recess 42 that is configured to receive a portion of each ball 34 in the unlocked configuration. The recess 42 in the lock mechanism 20 may be shaped such that when the ball(s) 34 is positioned in the recess 42, the ball is disengaged from the recess 36 in the connector 22. The lock mechanism 20 may include a biasing member 38 (e.g., a spring) that is configured to bias the lock mechanism or the connector 22 from the locked configuration to the unlocked configuration. Thus, when the connector 22 is inserted into the lock mechanism 20, the connector moves an engagement member 39 to load the biasing member 38, and when the connector is disengaged from the ball(s) 34, the biasing member biases the lock mechanism and the connector away from one another to the unlocked configuration. It can be seen that the engagement member 39 is configured to move within an opening defined in the lock mechanism 20 between the locked and unlocked configurations. In one embodiment, the connector 22 is configured to engage the lock mechanism 20 in a socket arrangement. In some cases, the biasing member 38 may automatically bias the lock mechanism 20 or the connector 22 towards a disengaged position.

The lock mechanism 20 may also include a blocking member 40 that is configured to prevent removal of the connector 22 and maintain engagement between the ball(s) 34 and the recess 36. When fully inserted in the lock mechanism 20, the blocking member 40 may prevent the connector 22 from being disengaged from the lock mechanism. The blocking member 40 may be operably engaged with a shape memory wire 46 (see, e.g., FIG. 11). The lock mechanism 20 is configured to move the blocking member 40 in response to contraction of the shape memory wire 46, which in turn releases the connector 22 from the lock mechanism. In one embodiment, the blocking member 40 is configured to move into and out of engagement with a shuttle 44 in response to actuation of the shape memory wire 46. When the blocking member 40 is moved, the connector 22 is biased such that the ball(s) 34 exit the recess 36 and enter the recess 42. The connector 22 may then be removed from the lock mechanism 20.

Figure 9:
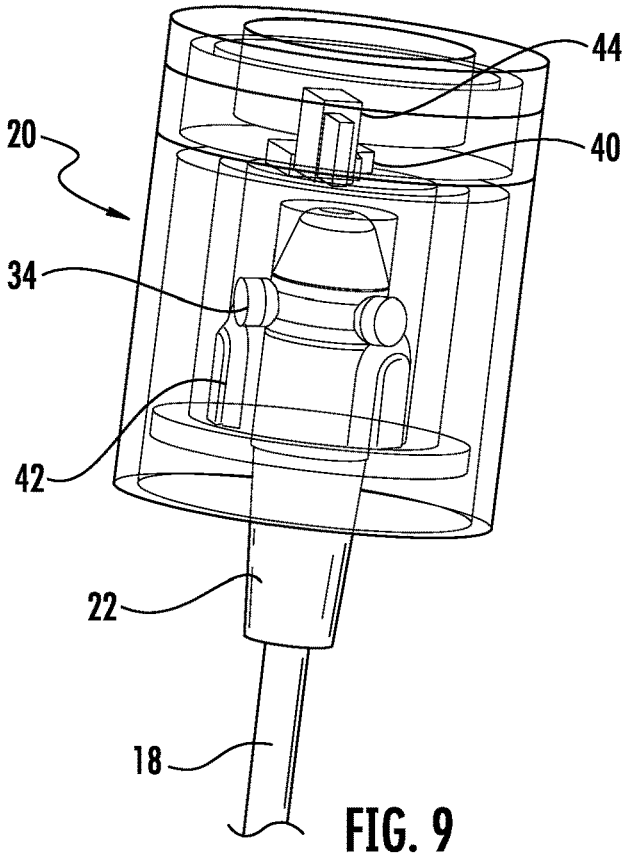
FIG. 9 is a perspective view of a lock mechanism in a locked configuration according to another embodiment of the present invention.
Figure 10:
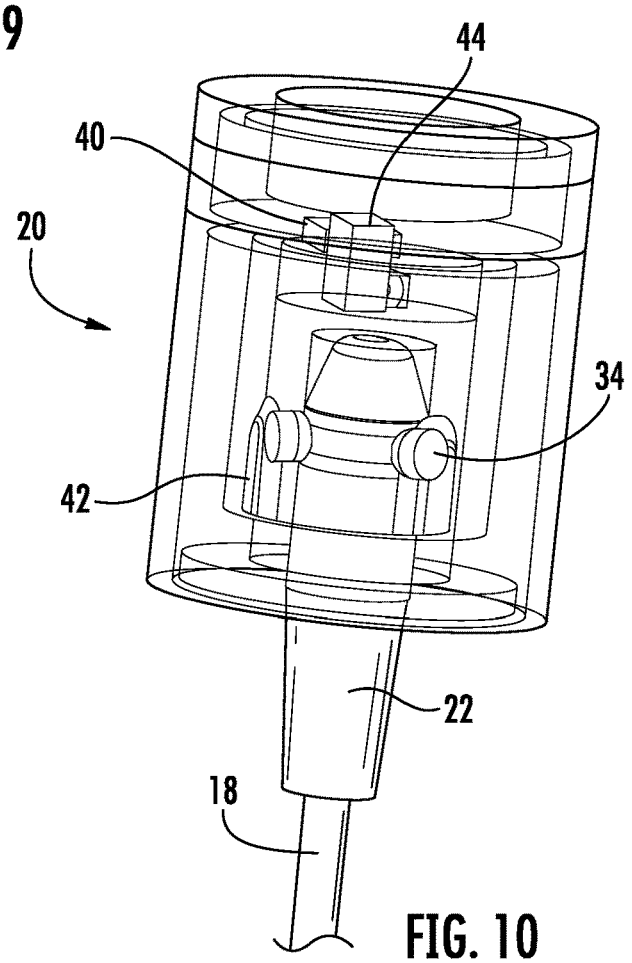
FIG. 10 is a perspective view of the lock mechanism in FIG. 9 in an unlocked configuration.
Figure 11:
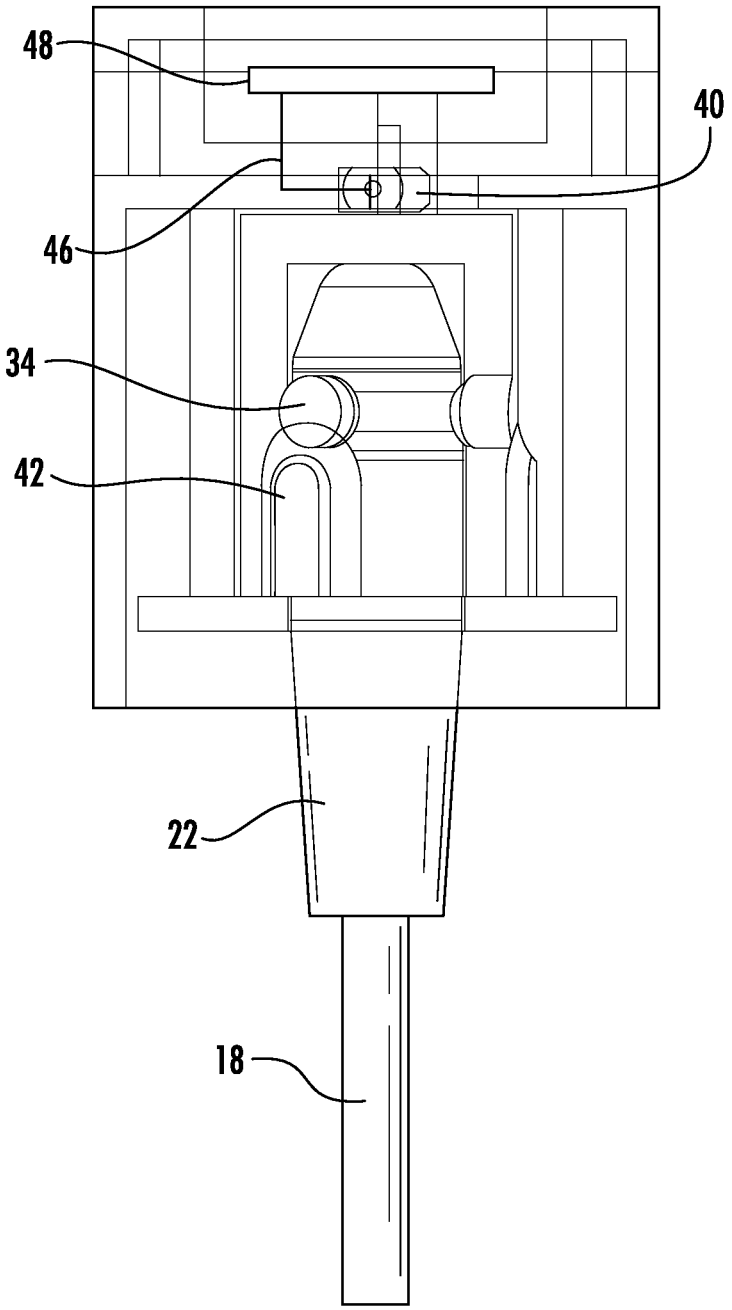
FIG. 11 is a side view of a lock mechanism according to one embodiment of the present invention.

FIGS. 9 and 10 illustrate an embodiment of a lock mechanism 20 in a locked configuration and an unlocked configuration, respectively, and the lock mechanism may function in a similar manner as that discussed above in FIG. 8. In addition, FIG. 11 shows an example of a shape memory wire 46 operably engaged with the blocking member 40, as well as a coil 48 that is operably engaged with the shape memory wire. As discussed above, the coil 48 is configured to receive electrical power from an electronic key 12 via a transfer port 30. As shown, the shape memory wire 46 is configured to contract to thereby move the blocking member 40 along an axis that is substantially perpendicular to the longitudinal axis of the connector 22. When the shape memory wire 46 is actuated, the blocking member 40 is moved out of engagement with the shuttle 44.

In one embodiment, the lock mechanism 20 may provide only mechanical security to the end of the tether 18. Thus, where the base 14 includes an alarm circuit 27, the alarm circuit may not detect unauthorized removal of the lock mechanism. However, it is understood that the lock mechanism 20 may be electrically connected to an alarm circuit 27 in other embodiments whereby the alarm circuit is configured to generate an alarm signal (e.g., an audible and/or visible alarm) in response to unauthorized removal of the lock mechanism from the tether 18 or the connector 22.

Figure 12:
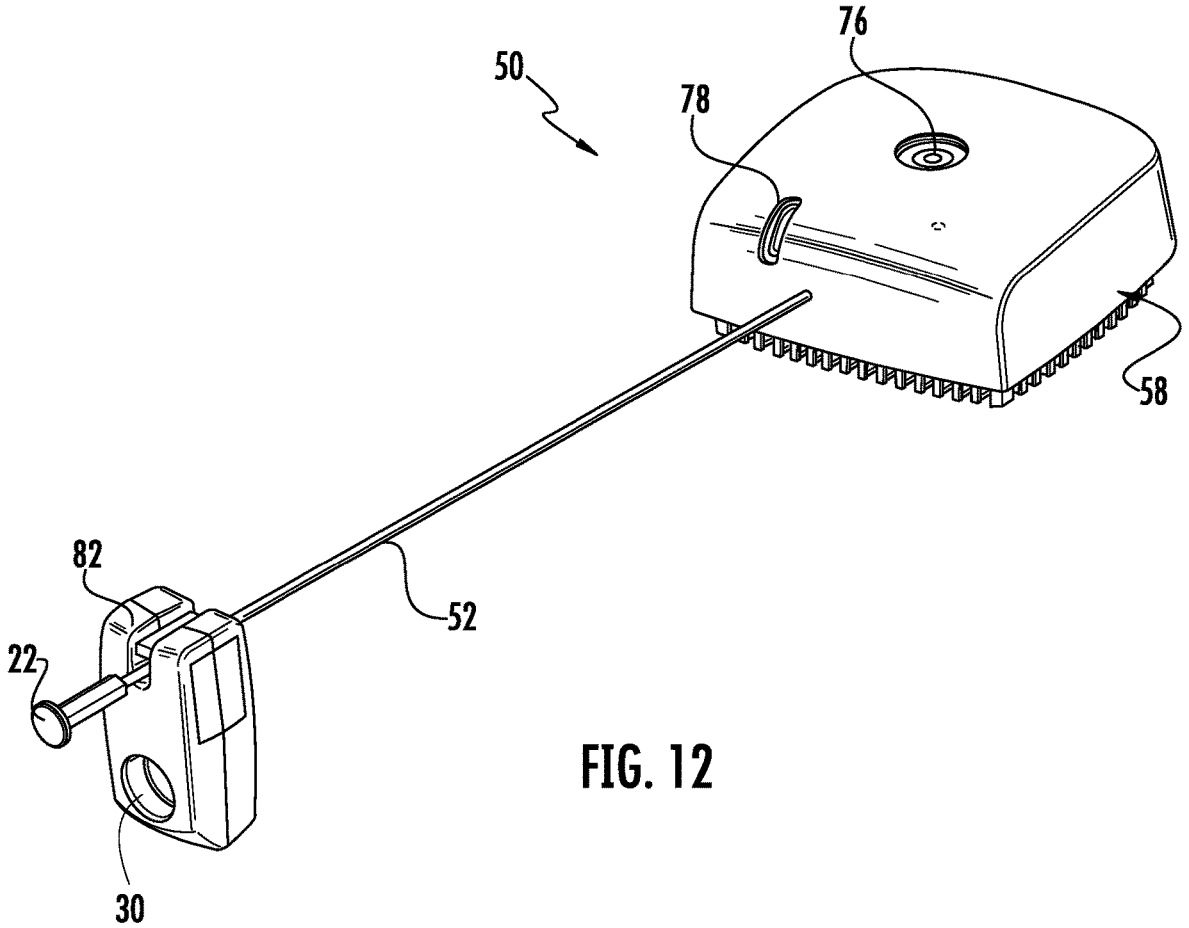
FIG. 12 is a perspective view of a merchandise display security device according to another embodiment of the present invention.
Figure 13:
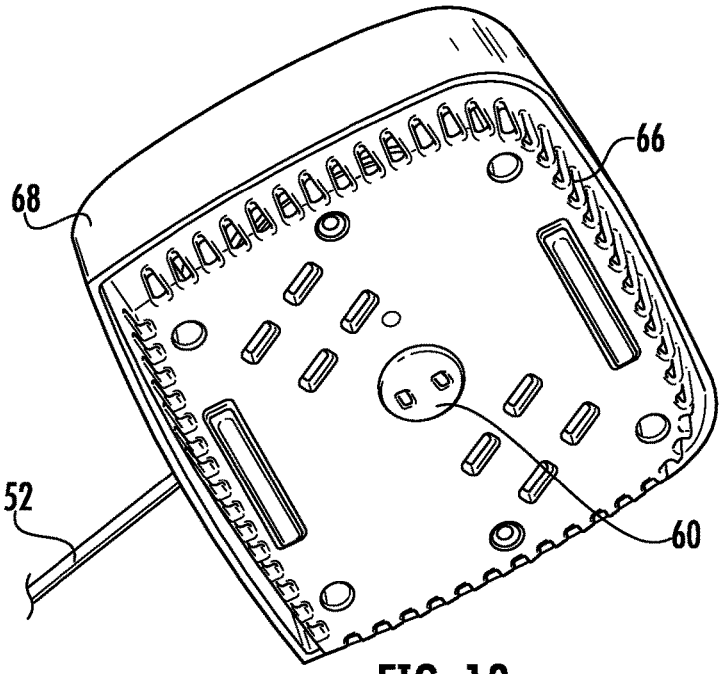
FIG. 13 is a bottom view of a base of the merchandise display security device shown in FIG. 12.
Figure 14:
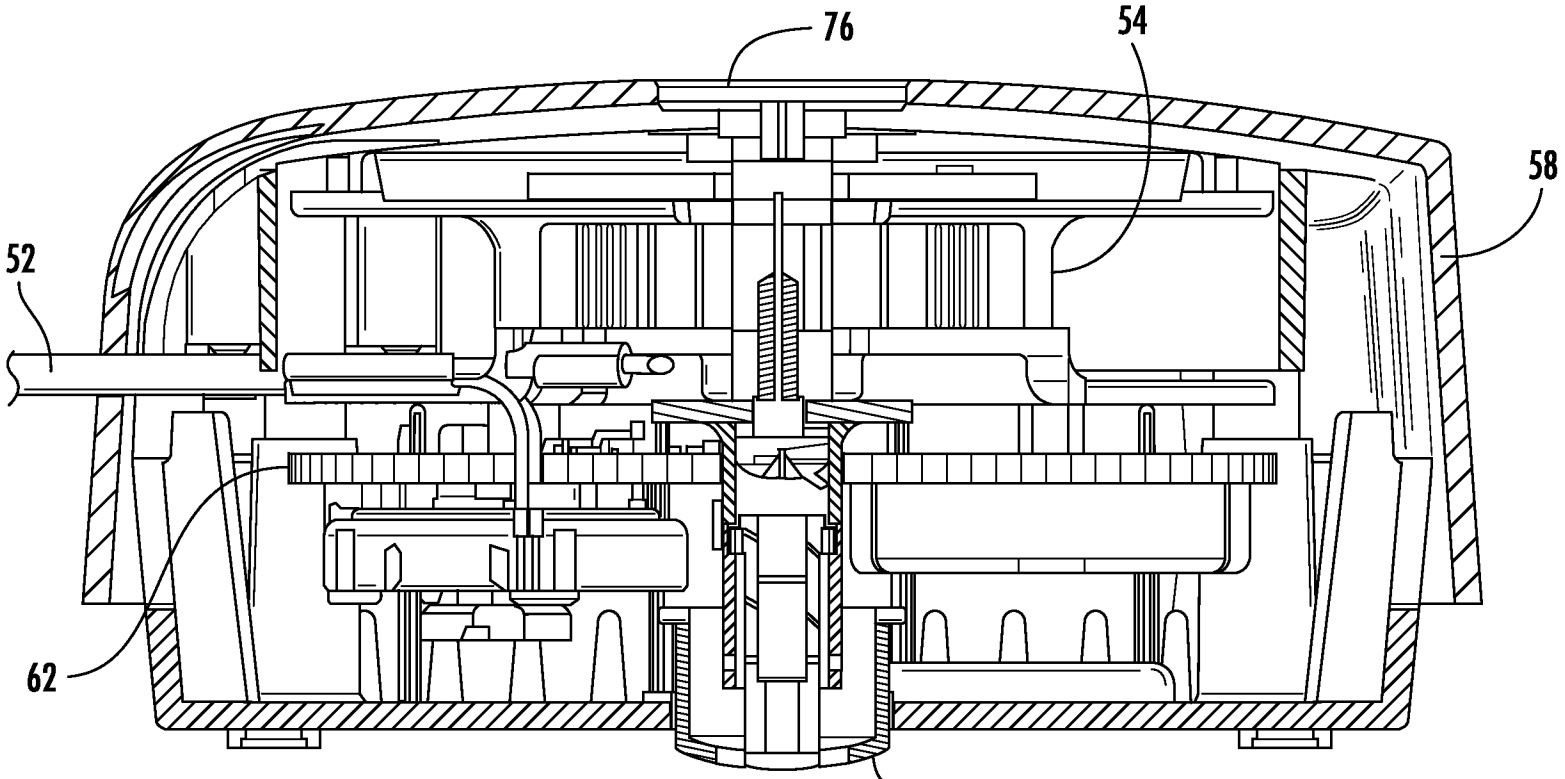
FIG. 14 is a cross-sectional view of the base of the merchandise display security device shown in FIG. 12.

FIGS. 12-14 show another embodiment of a merchandise display security device 50. Similar to the embodiments discussed above, the security device 50 includes a base 58 configured to be secured to a support surface 17. The base 58 may also include a transfer port 76 for communicating with an electronic key 12 for arming and/or disarming an alarm circuit. In one example, the base 58 also includes a visual indicator (e.g., an LED) for indicating a state or status of the base (e.g., armed, alarming, etc.). FIG. 12 also shows that the base 58 is coupled to a tether 52 that may be extended and retracted relative to the base. A connector 22 is disposed at the end of the tether 52. Moreover, a lock mechanism 82 is configured to lock to and unlock from the tether 52. In this embodiment, the lock mechanism 82 is configured to slide along the tether 52 while in a locked configuration. Thus, the connector 22 may not be locked to the lock mechanism 82 and may alternatively function as a blocking member and prevent the lock mechanism from sliding off of the end of the tether 52 when in a locked configuration. In this case, items of merchandise may be positioned between the lock mechanism 82 and the base 58.

In one embodiment, a recoiler 54 is provided within the base 58 and is coupled to the tether 52. The recoiler 54 may include a spool, and the tether 52 may be configured to be wound on the spool and to unwind as tension is applied to the end of the tether. The recoiler 54 may be biased to retract the tether 52 within the base 58 and onto the spool, such as with a suitable spring. The base 58 may also include a printed circuit board (PCB) 62. The PCB 62 may be electrically connected to one or more components of the security device, such as the tether 52, sensor 60, alarm circuit, the recoiler 54, and/or a power source.

Moreover, the base 58 may include a sensor 60 that is configured to be activated upon unauthorized removal of the base from a support surface 17, and the sensor may in electrical communication with an alarm circuit. For example, the sensor 60 may be a pressure or plunger switch. The pressure or plunger switch may be configured to engage a support surface 17 and to extend and retract relative to the base 54. The pressure or plunger switch may be biased to an extended position, such as with a spring. Thus, the alarm circuit may be configured to detect activation of the sensor 60 and to generate an audible and/or a visible alarm signal in response to the sensor being activated.

In some embodiments, the security device 50 is similar to that disclosed in U.S. Provisional Application No. 62/000,674, entitled Recoiler Sensor and filed on May 20, 2014, the disclosure of which is incorporated herein by reference in its entirety.

Based on the foregoing, it is apparent that any number of lock mechanisms 20, 82 may be employed, including in conjunction with various forms of power transfer for actuating a lock mechanism (e.g., inductive, capacitive, etc.). For example, where a shape memory material is utilized, a change in shape of the shape memory material may cause mechanical actuation (e.g., linear and/or rotary movement) of the lock mechanism. The shape memory material may be operably engaged with a lock mechanism 20, 82 in any number of configurations to facilitate such actuation. Moreover, the shape memory material may be any suitable material, such as a metal, a polymer, or a combination thereof, that is configured to change in shape (e.g., length, area, etc.) in response to a current or a change in temperature. In addition, other mechanisms may be utilized for actuating a lock mechanism, including mechanical, electrical, and/or chemical state changes. As such, the security devices 15, 50 and associated lock mechanisms 20, 82 should not be limited in light of the illustrated embodiments.

In some embodiments, the system 10 may further comprise an optional programming station that is operable for programming the key 12 with a security code, which is also referred to herein as a Security Disarm Code (SDC). A programming station and key 12 suitable for use with the present invention is shown and described in detail in U.S. Pat. No. 7,737,844, entitled Programming Station For a Security System For Protecting Merchandise, and U.S. Pat. No. 7,737,845, entitled Programmable Key for a Security System for Protecting Merchandise, the contents of which are incorporated herein by reference in its entirety. It is understood that in other embodiments, the electronic key 12 may be programmed without use of a programming station. For example, the key may be self-programming or could be pre-programmed with a particular security code.

In addition to programming station, the system 10 may further comprise an optional charging station that is operable for initially charging and/or subsequently recharging a power source disposed within the electronic key 12. The electronic key 12 may be provisioned with a single-use (e.g., non-rechargeable) power source, such as a conventional or extended-life battery, or alternatively, the key may be provisioned with a multiple-use (e.g., rechargeable) power source, such as a conventional capacitor or rechargeable battery. In either instance, the power source may be permanent, semi-permanent (e.g., replaceable), or rechargeable, as desired. In the latter instance, charging station is provided to initially charge and/or to subsequently recharge the power source provided within the electronic key.

In one embodiment, one or more components of the merchandise security device 15, 50 is a "passive" device. As used herein, the term passive is intended to mean that the security device does not have an internal power source (e.g., a battery) sufficient to lock and/or unlock a mechanical lock mechanism. Significant cost savings are obtained by a retailer when the merchandise security device 15, 50 is passive since the expense of an internal power source is confined to the electronic key 12, and one such key is able to operate multiple security devices. In addition, the security device 15, 50 may not require an electric motor, such as a DC stepper motor, solenoid, or the like, such as for locking or unlocking the lock mechanism. As such, the security device 15 may employ a simplified lock mechanism that does not require various components operated by its own source of electrical power.

Moreover, in some embodiments the merchandise security device 15, 50 is not required to include a logic control circuit, while the electronic key 12 includes such a logic control circuit. In this regard, some security devices include a logic control circuit adapted to perform a handshake communication protocol with the logic control circuit of the key (e.g., using an SDC). Thus, the security device 15, 50 may not include a logic control circuit used to communicate with the electronic key 12 in order to determine whether the merchandise security device is an authorized device. Likewise, the electronic key 12 may also not include a logic control circuit. Regardless of whether the electronic key 12 includes a logic control circuit, an SDC may be unnecessary where the electronic key is configured to transmit power to the security device 15, 50 that is not readily duplicated by a potential thief. For example, where the electronic key 12 is configured to transmit power inductively, the inductive signature may provide increased security relative to conventional mechanical locks that utilize mechanical or magnetic actuators. For example, the electronic key 12 may be configured to transmit an inductive signature including a particular amplitude and/or frequency of a power signal that is not readily apparent to, or duplicated by, a potential thief.

In one embodiment, the electronic key 12 does not transmit an SDC to the security device 15, 50. However, in other embodiments, the electronic key 12 may be configured to transmit an SDC to the security device 15, 50, such as for arming and/or disarming an alarm circuit. In this example, the security device 15, 50 may include a corresponding SDC. Thus, the electronic key 12 may be configured to perform a handshake communication protocol with the security device 15, 50. Where the SDC of the electronic key 12 matches the SDC of the security device 15, 50, the electronic key may then be configured to transmit electrical power to the security device.

However in other embodiments, the security device 15, 50 may not recognize the SDC transmitted by the electronic key 12, such as where the lock mechanism 20, 82 does not include a logic control circuit or a component including an SDC. If the electronic key 12 does not receive a return signal from the lock mechanism 20, 82, the electronic key may then transmit electrical power to the lock mechanism as described in further detail below. Thus, although the electronic key 12 may transmit an SDC to the lock mechanism 20, 82, the lock mechanism may not recognize the SDC and the SDC will not affect the operation of the lock mechanism. As will be readily apparent to those skilled in the art, the SDC may be transmitted from the electronic key 12 to the merchandise security device 15, 50 by any suitable means, including without limitation, via one or more electrical contacts, or via optical, acoustic, electromechanical, electromagnetic or magnetic conductors, as desired. Furthermore, the SDC may be transmitted by inductive transfer of data from the electronic key 12 to the merchandise security device 15, 50.

In one embodiment, the logic control circuit of the key 12 is configured to cause the internal power source of the key to transfer electrical power to the security device 15, 50 to operate a lock mechanism 20, 82 of the security device. In one embodiment, electrical contacts disposed on the electronic key 12 electrically couple with cooperating electrical contacts on the merchandise security device 15, 50 to transfer power from the internal battery of the key to the merchandise security device. Power may be transferred directly to the lock mechanism 20, 82 via one or more conductors. For example, a conductor may be coupled to a mechanical lock mechanism 20, 82, and when electrical power is conducted through the conductor, a state change occurs thereby resulting in operation of the lock mechanism. In one example, the conductor is coupled to a shape memory material (e.g., Nitinol) such that electrical power transferred through the conductor results in a change in shape of the shape memory material. Such a change in shape may cause a mechanical actuation (e.g., linear or rotary) of the lock mechanism 20, 82 to thereby lock or unlock the lock mechanism. In other embodiments, the lock mechanism may cooperate with a motor or solenoid for operating the lock mechanism.

An available feature of a merchandise security system 10 according to an embodiment of the invention is that the electronic key 12 may include a time-out function. More particularly, the ability of the key 12 to transfer data and/or power to the merchandise security device 15, 50 is deactivated after a predetermined time period. By way of example, the logic control circuit of the key 12 may be deactivated after about six to twelve hours (e.g., about eight hours) from the time the key was fully charged or programmed or last refreshed by the programming station. In this manner, an authorized sales associate typically must program or refresh the key 12 assigned to him at the beginning of each work shift. Furthermore, the charging station may be configured to deactivate the logic control circuit of the key 12 when the key is positioned within the charging station. In this manner, the charging station can be made available to an authorized sales associate in an unsecured location without risk that a charged key could be removed from the charging station and used to maliciously disarm and/or unlock a merchandise security device 15. The electronic key 12 would then have to be charged, programmed or refreshed by the programming station, which is typically monitored or maintained at a secure location, in order to reactivate the logic control circuit of the key.

The security device 15, 50 may include a transfer port 16, 30, 76 sized and shaped to receive a transfer probe of the electronic key. At least one, and sometimes, a plurality of magnets may be disposed within the transfer port 16, 30, 76 for securely positioning and retaining the transfer probe of the key 12 in electrical contact with electrical contacts of the mechanical lock mechanism 20. Power is transferred from the electronic key 12 to the security device 15, 50 through electrical contacts disposed on the transfer probe of the key and corresponding electrical contacts disposed within the transfer port 16, 30, 76 of the security device.

In another embodiment of a merchandise display security system, the system comprises an electronic key 12 with inductive transfer, and a merchandise security device 15, 50 that is operated by the key. However, the electronic key 12 is useable with any security device 12 or lock mechanism 20, 82 with inductive transfer capability that requires power transferred from the key to the device by induction, or alternatively, requires data transferred between the key and the device and power transferred from the key to the device by induction.

In one embodiment, the security device 15, 50 comprises an internal lock mechanism. A transfer port 16, 30, 76 may be formed in the security device 15, 50 that is sized and shaped to receive a transfer probe of the electronic key 12. If desired, the transfer port 16, 30, 76 may comprise mechanical or magnetic means for properly positioning and securely retaining the key 12 within the transfer port. In one embodiment, it is only necessary that the inductive transceiver of the electronic key 12 is sufficiently aligned or proximate to the corresponding inductive transceiver of the security device 15 or proximate to the transfer port 16, 30, 76. Therefore, magnets are not required to position, retain and/or maintain electrical contacts provided on the electronic key 12 in electrical contact with corresponding electrical contacts provided on the security device 15, 50. In the particular embodiment shown and described herein, data and/or power is transferred from the electronic key 12 to the security device 15, 50 by wireless communication, such as infrared (IR) optical transmission as discussed above. Power may be transferred from the electronic key 12 to the security device 15 by induction across the transfer port 16, 30, 76 of the security device using an inductive transceiver disposed within a transfer probe of the key that is aligned with a corresponding inductive transceiver disposed within the security device. For example, the transfer probe of the electronic key 12 may comprise an inductive transceiver coil that is electrically connected to the logic control circuit of the key to provide electrical power from the internal battery of the key to an inductive transceiver coil disposed within the security device 15, 50. The inductive transceiver coil of the security device 15, 50 may then transfer the electrical power from the internal battery of the key 12 to the lock mechanism 20, 82. Thus, the security device 15, 50 may include at least one conductor configured as a coil having a plurality of continuous windings. As previously mentioned, the power transferred from the key 12 may be used to unlock the lock mechanism 20 without the need for various other electrically powered mechanisms, for example, an electric motor, DC stepper motor, solenoid, or the like.

In some embodiments generally discussed above, a shape memory material may be employed, such as for use in conjunction with inductive power transfer. The shape memory material may be in electrical communication with the inductive coil and is configured to change in shape in response to electrical current being transmitted through the shape memory material. A change in shape of the shape memory material may, in turn, result in actuation of the lock mechanism. As such, the security device 15, 50 may also not require a rectifier for converting the alternating current into direct current for operating the lock mechanism 20, 82. In this regard, some security devices require that the alternating current induced in an inductive coil be transformed into a direct current, such as via a bridge rectifier or a logic control circuit, to provide direct current (DC) power to the security device. Such a conversion is not required by embodiments of the present invention, as the alternating current may be used to actuate the lock mechanism 20, 82. Indeed, the security device 15, 50 may also not require a battery, motor, solenoid, and/or any other electrical component as discussed above. Therefore, the lock mechanism 20, 82 is simplified for use with a variety of security devices.

In some embodiments, the security device and the electronic key are similar to those disclosed in U.S. Patent Publ. No. 2013/0081434, entitled Cabinet Lock for Use with Programmable Electronic Key and filed Sep. 28, 2012, U.S. Patent Publ. No. 2012/0047972, entitled Electronic Key for Merchandise Security Device and filed Aug. 31, 2011, and U.S. Patent Publ. No. 2011/0254661, entitled Programmable Security System and Method for Protecting Merchandise and filed Jun. 27, 2011, U.S. patent application Ser. No. 14/328,051, entitled Merchandise Security Devices for Use with an Electronic Key and filed on Jul. 10, 2014, each of which is incorporated herein by reference in its entirety. In other embodiments, the security device and the electronic key are similar to those manufactured by InVue Security Products Inc., including the Plunger Locks, Smart Locks, and IR2 and IR2-S Keys.

The foregoing has described one or more embodiments of a merchandise display security device for use with an electronic key. Embodiments of a merchandise display security system have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A security device for securing a plurality of items from theft, the security device comprising:

a base configured to be attached to a support surface, the base comprising an alarm circuit and a tether, the tether configured to be extended and retracted relative to the base an engagement mechanism independent of the base;

a connector at a free end of the tether configured to be removably engaged with the engagement mechanism, wherein the tether is configured to be extended from the base for securing the plurality of items between the engagement mechanism and the base when the connector is engaged with the engagement mechanism, wherein the tether is configured to retract relative to the base when the connector is disengaged from the engagement mechanism, wherein the alarm circuit configured to detect removal of the base from the support surface, and wherein the alarm circuit is configured to detect unauthorized removal of the connector from the engagement mechanism.

2. The security device of claim 1, wherein the tether is operably engaged with a recoiler disposed within the base, and wherein the recoiler is configured to retract the tether into the base.

3. The security device of claim 1, further comprising a shape memory material operably engaged with the engagement mechanism and configured to change in shape in response to receiving electrical power for disengaging the engagement mechanism from the connector.

4. The security device of claim 3, wherein the engagement mechanism is configured to receive electrical power inductively.

5. The security device of claim 3, wherein the shape memory material comprises a wire configured to contract in response to receiving electrical power.

6. The security device of claim 1, wherein the tether comprises at least one conductor in electrical communication with the alarm circuit.

7. The security device of claim 1, wherein the tether comprises a mechanical cable that is resistant to cutting.

8. The security device of claim 1, wherein the base is configured to communicate with an electronic key for arming or disarming the alarm circuit.

9. The security device of claim 1, wherein the connector is configured to cooperate with the engagement mechanism to prevent the engagement mechanism from being removed from the tether when the engagement mechanism is engaged with the connector.

10. The security device of claim 9, wherein the engagement mechanism is configured to releasably engage the connector.

11. The security device of claim 1, wherein the engagement mechanism is removable from the connector when disengaged.

12. The security device of claim 1, wherein the engagement mechanism is configured to be locked to and unlocked from the connector.

13. The security device of claim 1, wherein the tether is configured to extend linearly between the base and the engagement mechanism when the connector is engaged by the engagement mechanism.

14. The security device of claim 1, wherein the base comprises a sensor configured to be activated upon unauthorized removal of the base from the support surface, and wherein the sensor is in electrical communication with the alarm circuit.

15. A method for securing a plurality of items from theft, the method comprising:

attaching a base to a support surface, the base comprising an alarm circuit and a tether, the tether configured to be extended and retracted relative to the base;

extending the tether from the base; and removably engaging a connector at a free end of the tether to an engagement mechanism independent of the base to secure the plurality of items between the engagement mechanism and the base when the tether is extended from the base, wherein the alarm circuit is configured to detect removal of the base from the support surface and unauthorized removal of the connector from the engagement mechanism.

16. The method of claim 15, further comprising:

disengaging the engagement mechanism from the connector; and retracting the tether relative to the base.

17. The method of claim 15, further comprising actuating an electronic key for transferring electrical power to the engagement mechanism to disengage the engagement mechanism from the tether.

18. The method of claim 15, wherein removably engaging comprises locking the connector to the engagement mechanism.

19. The method of claim 15, further comprising actuating an electronic key for arming or disarming the alarm circuit.

* * * * *